United States Patent [19]

Wertenauer

[11] Patent Number: 4,782,424

[45] Date of Patent: Nov. 1, 1988

[54] CIRCUIT ARRANGEMENT FOR THE NON-CONTACTING CONTROL OF A SANITARY FITTING

[75] Inventor: Helmut Wertenauer, Stuttgart, Fed. Rep. of Germany

[73] Assignee: Hansa Metallwerke AG, Stuttgart, Fed. Rep. of Germany

[21] Appl. No.: 86,542

[22] Filed: Aug. 18, 1987

[30] Foreign Application Priority Data

Aug. 30, 1986 [DE] Fed. Rep. of Germany ..... 3629580

[51] Int. Cl.[4] ..... H01H 47/24

[52] U.S. Cl. ..... 361/175; 137/624.11

[58] Field of Search ..... 361/173, 175, 179, 181; 340/555, 556, 557, 600, 561, 562, 573; 137/624.11; 251/129.15

[56] References Cited

U.S. PATENT DOCUMENTS

| | | | |
|---|---|---|---|
| 3,575,640 | 4/1971 | Ishikawa | 361/181 |
| 3,799,198 | 3/1974 | Kijimoto | 361/173 |
| 4,064,509 | 12/1977 | Stockdale | 361/175 |

*Primary Examiner*—L. T. Hix
*Assistant Examiner*—David M. Gray
*Attorney, Agent, or Firm*—Fred Philpitt

[57] ABSTRACT

In a circuit arrangement for the non-contacting control of a sanitary fitting, the signal, by which the solenoid valve or valves is/are controlled, is monitored with regard to the leading or decaying edge. If the leading edge appears, then the sensitivity of the entire circuit arrangement is reduced from a higher to a lower value; on the other hand, if the decaying edge appears, then the sensitivity of the circuit arrangement is once more increased to the original higher value, possibly with a time lag. Due to this, a "self-holding effect" due to the flowing water is prevented from occuring.

7 Claims, 3 Drawing Sheets

CIRCUIT ARRANGEMENT FOR THE NON-CONTACTING CONTROL OF A SANITARY FITTING

DESCRIPTION

Figure 1:
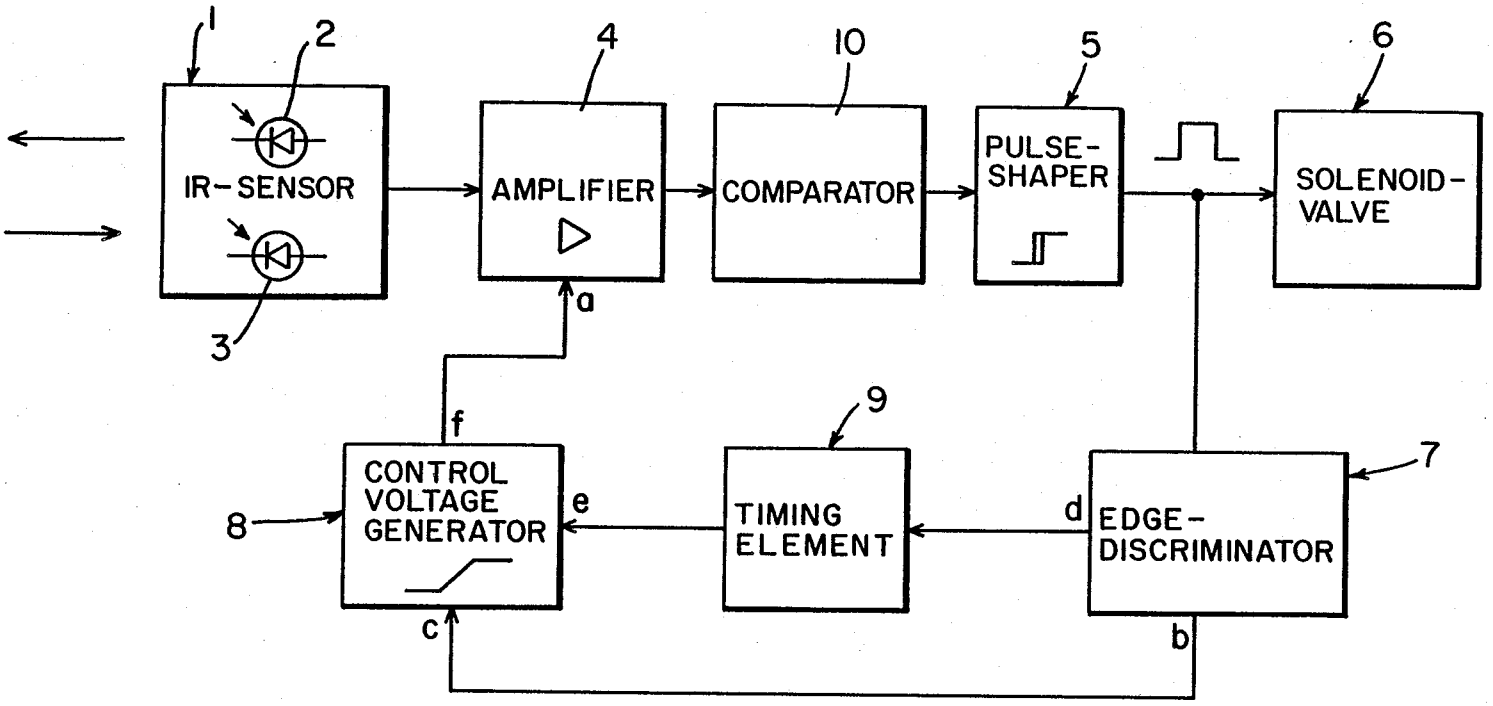

The invention relates to a circuit arrangement for the non-contacting control of a sanitary fitting with (a) a sensor, which contains a light source and a light receiver picking-up the light reflected on the user, whereby with great sensitivity the water jet of the sanitary fitting is located in the detection range of the sensor;

(b) an amplifier, which amplifies the signal produced by the light receiver;

(c) a comparator, which compares the output signal of the amplifier with a certain threshold value and if this hreshold value is exceeded produces an output signal;

(d) a pulse shaper, whereof the output signal, upon the appearance of the output signal of the comparator with the formation of a first, generally leading edge, changes from a first to a second value and in the absence of the output signal of the comparator, possibly with a time lag, with the formation of a second, generally decaying edge, changes from the second to the first value;

(e) at least one solenoid valve, which is controlled by the output signal of the pulse shaper and releases the flow of water as long as this output signal has its second value.

In known, presently commercially available circuit arrangements of this construction, the following problem occurs: the sensitivity of the entire circuit arrangement should not be too great, since otherwise the jet of water emerging from the sanitary fitting would lie in the detection region of the sensor and a "self-holding effect" would result. By this it is meant that the water jet itself would be interpreted by the circuit arrangement as a tripping object and the fitting would no longer switch off after the user had moved aside. In the known circuit arrangements, it is therefore normally necessary to adjust the detection range of the sensor by reducing the sensitivity exactly so that the water jet lies just outside the detection range. This has the double drawback that a different adjustment must take place according to the outflow length and that on the other hand the user must move his hands closer to the sensor than corresponds to the distance between the water jet and sensor. This makes it more difficult for the circuit arrangement or the sanitary fitting to be used in particular by people who have not been instructed about the method of operation of the circuit arrangement.

It is the object of the present invention to construct a circuit arrangement of the afore-mentioned type so that the range of sensitivity can be adjusted to be so great that as the user casually approaches the sanitary fitting, tripping may take place, but on the other hand no self-holding effect due to the water jet occurs.

This object is achieved according to the invention by (f) an edge discriminator, which monitors the appearance of the first and second edge in the output signal of the pulse shaper;

(g) a device, which is controlled by the edge discriminator, reduces the sensitivity of the circuit arrangement upon the appearance of the first edge of the output signal of the pulse shaper from a high to a low value and upon the appearance of the second edge of the output signal of the pulse shaper, possibly with a time lag, returns the sensitivity from the low to the high value.

Thus, according to the invention, the circuit arrangement is operated with two different sensitivities. In the "inoperative condition", in which no water flows and the sanitary fitting "is waiting" for the next user, the sensitivity is high. The adjustment of this high sensitivity may take place freely according to points of view of suitability so that a user approaching the sanitary fitting casually, can bring about tripping of the latter without a particular movement of the hands towards the sensor. On the other hand, once the water is running, the sensitivity of the circuit arrangement is reduced so far that the feared self-holding effect does not occur. When the water has again stopped running, the sensitivity is restored to the higher value prevailing in the inoperative condition.

Appropriately, varying the sensitivity is naturally brought about by electrical means. According to one feature of the invention, it is therefore provided that the device for varying the sensitivity comprises a control voltage generator, whereof the control voltage, controlled by the edge discriminator, can optionally assume a first value, which corresponds to the lower sensitivity and a second value, which corresponds to the higher sensitivity.

In order to avoid instability at the time of transition from one sensitivity value to the other sensitivity value, it is recommended that the transition between the two values of the control voltage of the control voltage generator takes place continuously within a pre-determined time interval with the formation of a ramp.

In one embodiment of the invention, the amplification factor of the amplifier is variable; then the control voltage of the control voltage generator is fed to a control input of the amplifier.

In a second embodiment of the invention, the threshold value of the comparator is variable; then the control voltage of the control voltage generator is fed to a control input of the comparator.

Finally, in a third embodiment of the invention the light intensity of the light source in the sensor is variable; then the control voltage of the control voltage generator is fed to a control input of the sensor.

In order to take into consideration the mechanical inertia of the solenoid valve and the ever present overrunning time of the water after closing the solenoid valve, it is recommended that upon the appearance of the second edge of the output signal of the pulse shaper, a time element is located in the signal path between the edge discriminator and the control voltage generator, which time element delays the change from the first to the second value of the control voltage of the control voltage generator by a certain time.

Figure 2:
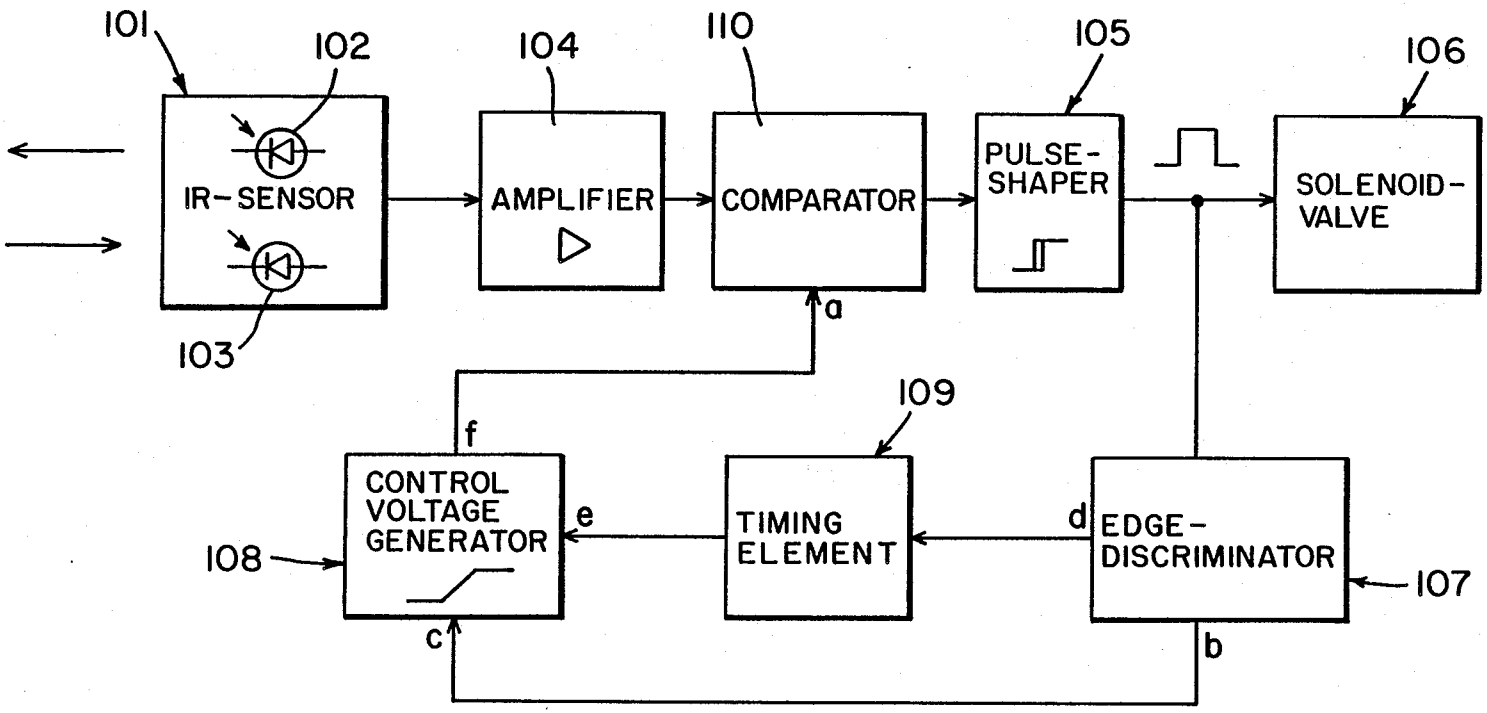
Figure 3:
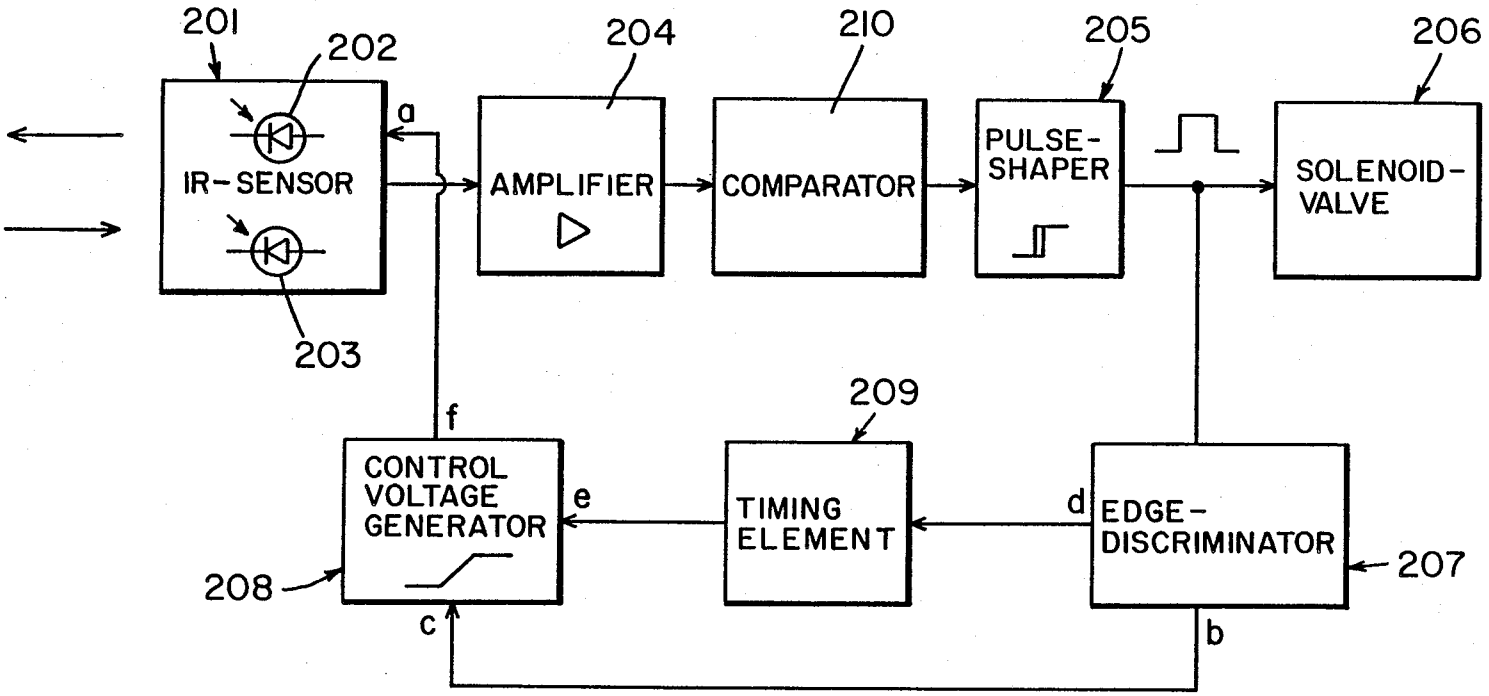

Embodiments of the invention are described in detail hereafter with reference to the drawings; FIGS. 1 to 3 show diagrammatically three embodiments of circuit arrangements for non-contacting control of a sanitary fitting.

The circuit arrangement illustrated in FIG. 1 in known manner comprises a sensor 1 with an emitting diode 2, which serves as a light source and in particular emits IR-light. The light reflected by the user or another object is picked-up by a receiving diode 3, which represents a light receiver. The output signal of the latter is sent to an amplifier 4. When the amplified signal exceeds a certain threshold value pre-determined in a comparator 10, it passes to a pulse shaper 5, in which the pulses required for controlling a solenoid valve 6 are formed in a familiar manner and are provided with the desired time delays and durations. The output signal of the pulse shaper 5 is normally a square wave signal. It comprises a first, generally leading edge, during which the solenoid valve is actuated so that the water begins to flow. The decaying edge generally follows with a certain time lag after the instant at which the user or the tripping object has moved away from the sensor 1 so far that the threshold value in the comparator 10 is no longer reached.

The circuit arrangement described so far is conventional. However, the method of operation of the circuit arrangement in and between two different sensitivities to be described hereafter is new.

For this purpose, in the embodiment illustrated in FIG. 1, the amplifier 4 is equipped with a controllable amplification factor. The latter can be adjusted by a control voltage which is applied to a control input a of the amplifier 4. The output signal of the pulse shaper 5 is sent to an edge discriminator 7. If the latter registers the leading edge of the signal, ie the edge tripping the solenoid valve, it produces an output signal at a first output b. This signal is applied to a first input of a control voltage generator 8.

If the edge discriminator 7 registers the decaying edge of the output signal of the pulse shaper 5, terminating the activity of the solenoid valve 6, then an output signal appears at its second output d. This signal is supplied to a timing element 9 and, delayed by the latter by a certain time interval, is supplied to a second input e of the control voltage generator 8.

In the stationary state, according to conditions which will be described hereafter, the control voltage generator 8 produces at its output a control voltage with two different values, which is applied to the control input a of the amplifier 4. The first value of the control voltage corresponds to a lower amplification factor of the amplifier 4, thus to lower sensitivity of the entire circuit arrangement. The second value of the control voltage corresponds to a greater amplification factor of the amplifier 4, thus to greater sensitivity of the entire circuit arrangement. The control voltage may change between the two values within a definite time interval continuously with the formation of a ramp.

The operation of the afore-described circuit arrangement is as follows:

in the inoperative state, the solenoid valve 6 is closed, so that no water leaves the sanitary fitting. The second value of the control voltage is present at the control input a of the amplifier 4, which value corresponds to the greater sensitivity of the circuit arrangement. In principle, this value can be chosen to be as high as desired, irrespective of the condition of the water jet, which does not flow in the inoperative state.

Now if a user approaches the wash basin or the like, on which the sanitary fitting is located, then already at a relatively great distance, the ( amplified) sensor signal exceeds the threshold value set in the comparator 10. In particular it is not necessary for the user to move his hands towards the inlet and outlet window of the sensor 3 in order to actuate the sanitary fitting, which would pre-suppose a certain knowledge of the method of operation.

The pulse shaper 5 thus follows the comparator 10; with the formation of the leading edge, the potential of its output signal changes. The solenoid valve now responds and the water begins to flow.

In the meantime, the edge discriminator 7 has detected the leading edge of the output signal of the pulse shaper 5 and by way of an output signal at the output b controls the input c of the control voltage generator 8. The control voltage for the amplifier 4 produced at the output f of the control voltage generator 8 now changes within a pre-determined time interval from the second to the first value, which corresponds to a lower sensitivity of the circuit arrangement. This lower sensitivity is adjusted so that the water jet (which is now flowing) lies outside the tripping range of the sensor 1. If the user of the sanitary fitting now withdraws his hands from the water jet, then the sensor signal falls below the threshold value set in the comparator 10. With the formation of the decaying edge, the output signal of the pulse shaper 5 changes to its inoperative value (possibly with a certain time lag). The coil of the solenoid valve 6 is de-excited; the water ceases to flow.

The edge discriminator 7 detects the decaying edge of the output signal of the pulse shaper 5 and controls the timing element 9 by way of its output d. The latter sends a signal to the input e of the control voltage generator 8 with a certain time lag. The time lag corresponds to the mechanical inertia of the solenoid valve 6 and to the normal running-on time of the water after switching-off the solenoid valve 6. It is thus ensured that at the time when a signal is applied to the input e of the control voltage generator 8, in fact water no longer leaves the outlet of the sanitary fitting. Otherwise, a self-holding effect due to the flowing water would result.

Upon the signal present at its input e, the value of the control voltage for the amplifier 4, present at its output f, changes within a certain time, with the formation of a ramp, from the first to the second value, which corresponds to the greater sensitivity of the circuit arrangement. This is now again in the inoperative state.

The ramp-like transition between the two values of the control signal at the input a of the amplifier 4 prevents instability (pulsation) at the transition between the two different sensitivities of the circuit arrangement.

The embodiment of the circuit arrangement illustrated in FIG. 2 corresponds largely as regards function and construction to the example of FIG. 1. Corresponding parts are therefore characterised by the same reference numerals plus 100.

The single difference in the embodiment according to FIG. 2 consists in that the amplifier 104 has a fixed, non-controllable amplification factor. On this occasion, the threshold value in the comparator 110 may be varied for regulating the sensitivity. If the second value of the control voltage of the control voltage generator 108 is present at the input a of the comparator 110, in the inoperative state of the circuit arrangement, then the threshold value of the comparator 110 is low. This corresponds to high sensitivity. On the other hand, if the first value of the control voltage of the control voltage generator 108 is present at the input a of the comparator 110 (thus substantially at the time when water emerges from the outlet of the sanitary fitting), then the threshold value of the comparator 110 is high. This corresponds to low sensitivity of the circuit arrangement.

In the embodiment according to FIG. 3, a third type of sensitivity control is realised. The various members again bear the same reference numeral as in FIG. 2, this time increased by 200.

The control signal of the control voltage generator 208 is now supplied to the sensor 201, more accurately to the driver circuit contained therein for the emitting diode 202. If it has its second value, then the emitting diode 202 receives more current; it then emits a greater light intensity. This corresponds to great sensitivity of the circuit arrangement. However, as long as the first value of the control voltage is present at the input a of the sensor 201, the emitting diode 202 receives less current and emits light with a lower intensity. This again corresponds to a lower sensitivity of the circuit arrangement.

I claim:

1. A circuit arrangement for non-contacting control of the water flow of a sanitary fitting which includes:

(a) a sensor which contains a light source and a light receiver that can pick up the light reflected on a user and generate a signal whereby in a case of great sensitivity the water jet of the sanitary fitting is located in the detection range of the sensor;

(b) an amplifier which amplifies the signal produced by said light receiver;

(c) a comparator which compares the output signal of said amplifier with a certain threshold value and which produces an output signal if this threshold value is exceeded;

(d) a pulse shaper having an output signal which changes from a first to a second value forming a first generally rising pulse edge when the output signal of said comparator appears, and which changes fropm said second value to said first value forming a second generally decaying pulse edge when the output signal of said comparator disappears with or without a time lag, (e) at least one solenoid valve which is controlled by the output signal of said pulse shaper and which releases the water flow as long as this output signal has its second value, (f) an edge discriminator which monitors the appearance of said first pulse edge and of said second pulse edge in the output signal of said pulse shaper; and (g) a device which is controlled by said edge discriminator and which reduces the sensitivity of the circuit arrangement upon the appearance of said first pulse edge of the output signal of said pulse shaper from a high to a low value and upon the appearance of said second pulse edge of said output signal of said pulse shaper returns the sensitivity from said low to said high value with or without a time lag.

2. Circuit arrangement according to claim 1, characterised in that the device for varying the sensitivity comprises a control voltage generator whereof the control voltage, controlled by the edge discriminator, may optionally assume a first value, which corresponds to the lower sensitivity and a second value, which corresponds to the greater sensitivity.

3. Circuit arrangement according to claim 2, characterised in that the transition between the two values of the control voltage of the control voltage generator takes place continuously within a predetermined time interval with the formation of a ramp.

4. Circuit arrangement according to claims 2 or 3, characterised in that the amplification factor of the amplifier is variable and the control voltage of the control voltage generator is fed to a control input (a) of the amplifier.

5. Circuit arrangement according to claim 2, characterised in that the threshold value of the comparator is variable and the control voltage of the control voltage generator is fed to a control input (a) of the comparator.

6. Circuit arangement according to claim 2, characterised in that the light intensity of the light source in the sensor is variable and the control voltage of the control voltage generator is fed to a control input (a) of the sensor.

7. Circuit arrangement according to claim 2, characterised in that upon the appearance of the second edge of the output signal of the pulse shaper a time element is located in the signal path between the edge discriminator and the control voltage generator, which element delays the change from the first to the second value of the control voltage of the control voltage generator by a certain time.

* * * * *